US010070486B2

(12) United States Patent
Imm et al.

(10) Patent No.: US 10,070,486 B2
(45) **Date of Patent: *Sep. 4, 2018**

(54) OVER-THE-RANGE MICROWAVE OVEN AND METHOD OF USING THE SAME

(71) Applicant: Dongbu Daewoo Electronics Corporation, Seoul (KR)

(72) Inventors: Jun Hyuk Imm, Seoul (KR); Jong Jin Lee, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 280 days.

This patent is subject to a terminal disclaimer.

(21) Appl. No.: 14/598,152

(22) Filed: Jan. 15, 2015

(65) Prior Publication Data

US 2016/0165675 A1 Jun. 9, 2016

(30) Foreign Application Priority Data

Dec. 5, 2014 (KR) ..... 10-2014-0174470

(51) Int. Cl.

| | |
|---|---|
| ***H05B 6/50*** | (2006.01) |
| ***H05B 6/64*** | (2006.01) |
| ***F24C 15/20*** | (2006.01) |
| ***F24C 15/00*** | (2006.01) |

(52) U.S. Cl.

CPC ..... *H05B 6/6423* (2013.01); *F24C 15/006* (2013.01); *F24C 15/20* (2013.01); *F24C 15/2042* (2013.01)

(58) Field of Classification Search

CPC .... H05B 6/6423; H05B 6/6429; H05B 6/642; H05B 6/645; H05B 6/6458; H05B 33/10; H05B 33/28; H05B 6/6461; H05B 6/6476; H05B 6/6482; F24C 15/006; F24C 15/20; F24C 15/2042; F04D 29/422; F04D 29/4226; F04D 29/663; F04D 29/665; F04D 17/02; F04D 17/10; F04D 25/02; F04D 25/166; F04D 29/283; F04D 29/4213; F04D 29/424; F04D 29/44

USPC ..... 219/757, 702, 758, 756, 759, 751, 735, 219/710, 720, 707, 716, 740, 741, 745, 219/746, 750; 126/299 D

See application file for complete search history.

(56) References Cited

U.S. PATENT DOCUMENTS 4,886,046 A 12/1989 Welch
6,335,518 B1 * 1/2002 Kim ..... H05B 6/645 126/21 A (Continued)

FOREIGN PATENT DOCUMENTS

EP 1220577 A2 7/2002
KR 2002325230000 9/2001

(Continued)

*Primary Examiner* — David Angwin
*Assistant Examiner* — Chris Liu

(57) ABSTRACT

An over-the-range microwave oven including a duct unit configured to direct air from the back of the oven to the front. The duct unit includes a first panel disposed between the housing and the cooking unit of the oven. The first panel forms a bottom wall of the duct unit. The duct unit further includes at least a pair of second panels disposed on both lateral sides of the first panel. The gap between the pair of second panels decreases from one side end toward the other side end.

7 Claims, 3 Drawing Sheets

(56) References Cited

U.S. PATENT DOCUMENTS

| | | | | |
|---|---|---|---|---|
| 2002/0063126 | A1* | 5/2002 | Kim | H05B 6/6476 219/685 |
| 2002/0084267 | A1* | 7/2002 | Kim | H05B 6/6423 219/757 |
| 2008/0156793 | A1 | 7/2008 | Song et al. | |
| 2008/0156794 | A1* | 7/2008 | Song | H05B 6/6423 219/757 |
| 2010/0170895 | A1* | 7/2010 | Yi | F24C 15/023 219/757 |
| 2011/0017729 | A1* | 1/2011 | Choi | H05B 6/642 219/730 |
| 2016/0165673 | A1* | 6/2016 | Imm | H05B 6/6444 219/710 |

FOREIGN PATENT DOCUMENTS

| | | | | |
|---|---|---|---|---|
| KR | 1020040042931 | | | 5/2004 |
| KR | 1020110063929 | | | 6/2011 |
| KR | 20130036415 | A | * | 4/2013 |
| KR | 1020130036415 | A | | 4/2013 |

* cited by examiner

OVER-THE-RANGE MICROWAVE OVEN AND METHOD OF USING THE SAME

CROSS-REFERENCE TO RELATED APPLICATION

This application claims benefit and priority to Korean Patent Application No. 10-2014-0174470, filed on Dec. 5, 2014, with the Korean Intellectual Property Office, the disclosure of which is incorporated herein in its entirety by reference.

TECHNICAL FIELD

Embodiments of the present disclosure relate to microwave ovens, and more specifically, relate to ventilation mechanisms of over-the-range ovens.

BACKGROUND

In general, an over-the-range microwave oven refers to a microwave oven equipped with a venting system for exhauting heat, air and/or fumes during cooking. An over-the-range microwave oven is usually mounted above a gas or electric range. An air discharge unit is typically included in an air discharge duct and air flow of about 400 CFM can be achieved.

It is desirable to improve air discharge efficiency (or the ventilation efficiency) of an over-the-range oven. However, many issues tend to arise from efforts to improve the air discharge units, such as turbulent flows formed in the air discharge unit, increased noise level, and increased power consumption. These issues unfortunately counteract the efficiency of the oven,

SUMMARY

Therefore, it would be advantageous to develop an over-the-range microwave oven design with improved power efficiency and low noise level as well as ventilation efficiency.

Embodiments of the present disclosure are directed to providing a range hood or an over-the-range microwave oven offering increased air discharge efficiency, less turbulence, improved power efficiency and reduced noise level.

An exemplary embodiment of the present disclosure provides an over-the-range microwave oven including: a housing; a cooking unit in the housing; a duct unit in the housing; a first panel disposed between the housing and the cooking unit, forming a flow path, and forming a bottom surface of the duct unit; and at least a pair of second panels which is disposed on both lateral sides of the first panel and disposed so that the distance therebetween decreases from one side end toward the other side end.

In addition, the over-the-range microwave oven may further include an air discharge unit disposed in the rear of the housing and allows air to flow into the inlet hole. The air discharge unit includes an air discharge motor, and an impeller that draws air from the outside the oven to the inlet hole.

The over-the-range microwave oven may further include a third panel disposed in the rear of the pair of second panels and has an inlet hole.

The third panel may include a first inlet hole and a second inlet hole. The impeller may include a first impeller disposed on one side of the air discharge motor so as to allow air to flow into the first inlet hole, and a second impeller disposed on the other side of the air discharge motor so as to allow air to flow into the second inlet hole.

In addition, the third panel may further include a bent portion which protrudes forward between the first inlet hole and the second inlet hole.

The bent portion may be formed narrower toward the front side.

The bent portion may be formed in a trapezoidal shape.

The pair of second panels may include: a pair of first horizontal portions disposed at both sides of the third plate, respectively, and in parallel with each other; a pair of inclined portions which extends from the pair of first horizontal portions, respectively, and has an interval therebetween that gradually decreases; and a pair of second horizontal portions which is extended from the pair of inclined portions, respectively, and in parallel to each other.

In addition, a connecting surface formed between the first horizontal portion and the inclined portion or a connecting surface between the inclined portion and the second horizontal portion may be tapered or rounded.

The pair of second panels may be formed symmetrically.

In addition, a filter may be disposed in front of the pair of second plates.

Another exemplary embodiment of the present disclosure provides a method of using an over-the-range microwave oven, including: operating an air discharge unit; and discharging by the operation of the air discharge unit, air around a gas range or air flowing by a drive unit of a microwave oven through an upper duct unit. The upper duct unit is disposed between a housing and a cooking unit and forms a flow path. The upper duct unit includes: a first panel which is disposed at an upper side of the cooking unit; a pair of second panels which is disposed between the first panel and the housing and is disposed symmetrically so that a distance therebetween decreases toward the front side; and a third panel which is disposed at the rear of the pair of second panels and has inlet holes into which air flows.

According to the present disclosure, the air discharge unit is configured to allow air to flow from the rear side of the microwave oven to the front side. The third panel has a protruding poriton. The duct structure of the second panels is symmetrically formed and the distance therebetween increasingly shrinks. As a result, turbulent flow can be effectively reduced or prevented when the air discharge unit operates, thereby providing an over-the-range microwave oven design that is excellent in terms of electric power consumption characteristics, and reduces noise level.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
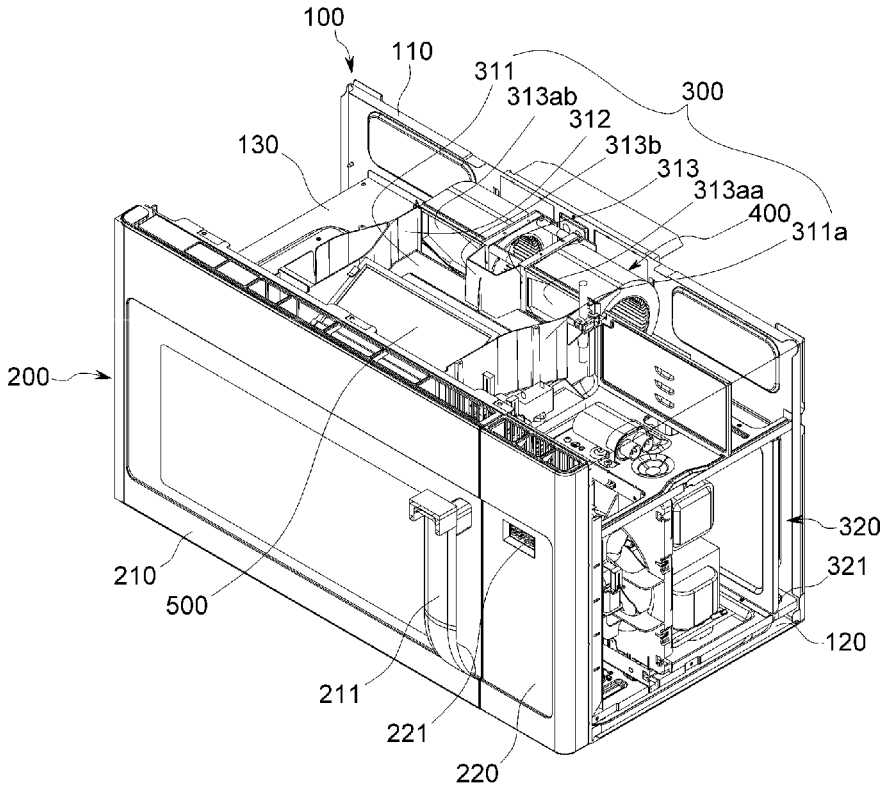
FIG. 1 illustrates the configuration of an exemplary over-the-range microwave oven design according to an embodiment of the present disclosure.

In the following detailed description, reference is made to the accompanying drawing, which forms a part hereof. The illustrative embodiments described in the detailed description, drawing, and claims are not meant to be limiting. Other embodiments may be utilized, and other changes may be made, without departing from the spirit or scope of the subject matter presented here.

Hereinafter, an exemplary embodiment of the present disclosure will be described in detail with reference to the accompanying drawings.

Unless particularly defined otherwise, all terms used in the present specification are the same as the general meanings of the terms understood by those skilled in the art, and if the terms used in the present specification conflict with general meanings of the corresponding terms, the meanings of the terms comply with the meanings defined in the present specification.

However, the present disclosure, which is disclosed below, is intended to merely describe the exemplary embodiment of the present disclosure, but is not intended to limit the scope of the present disclosure, and like reference numerals designate like elements throughout the specification.

Figure 2:
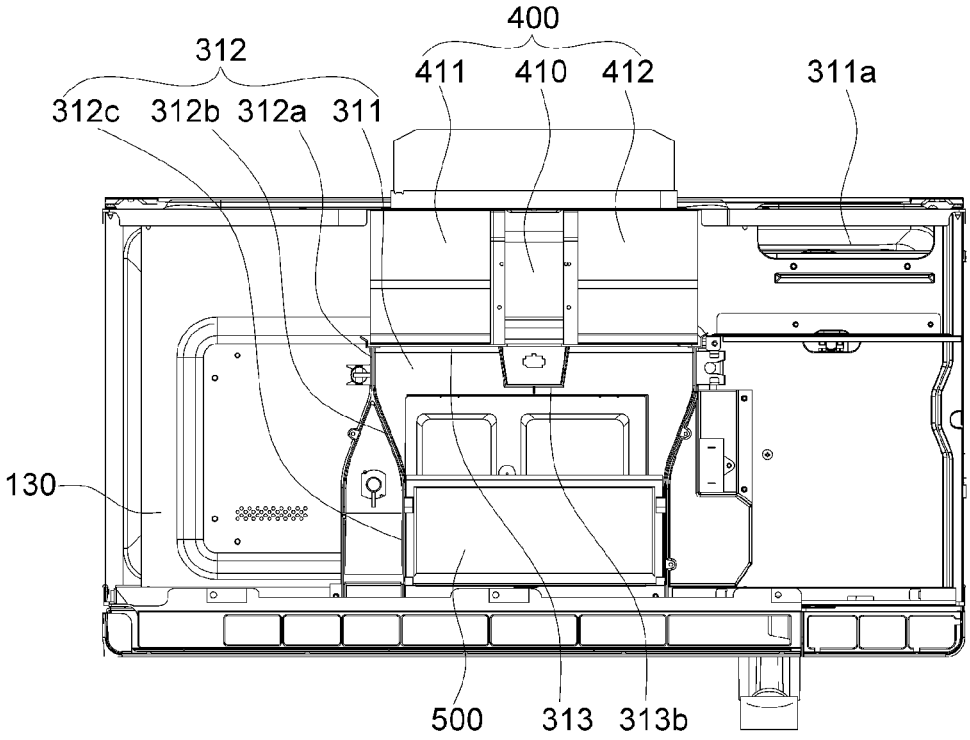
FIG. 2 is a top view of FIG. 1.
Figure 3:
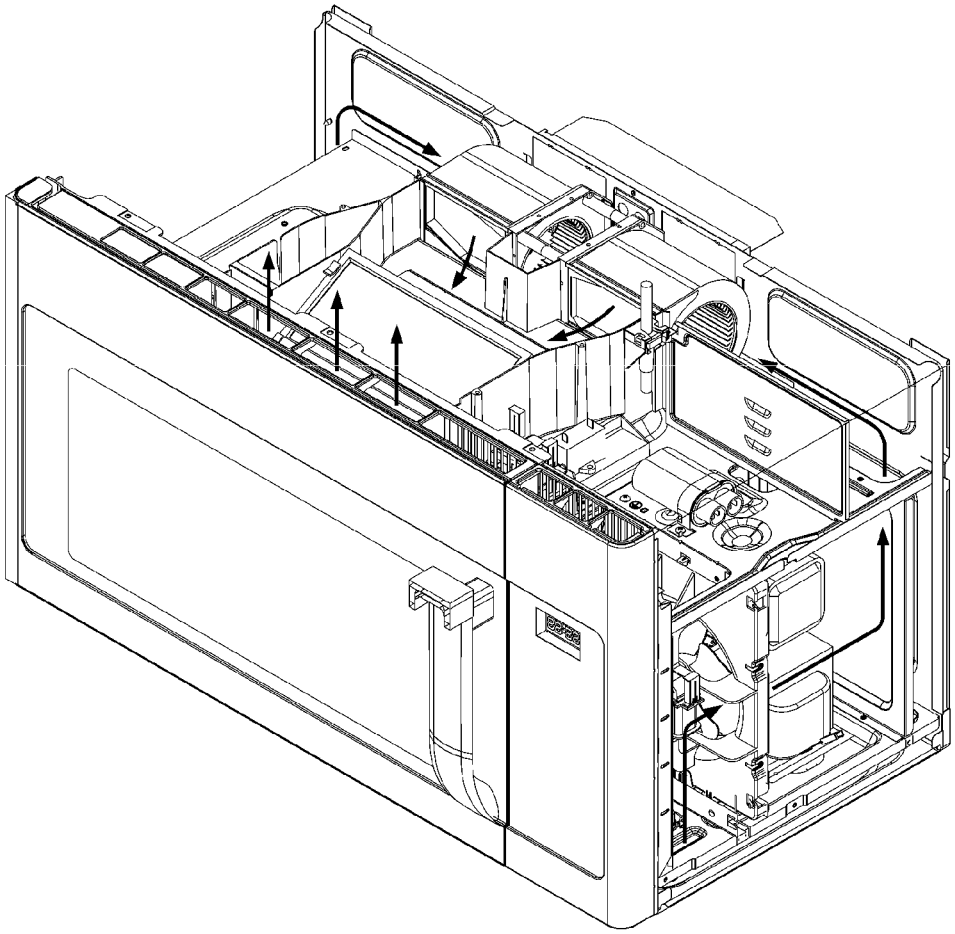
FIG. 3 illustrates the air flow directions in the an exemplary over-the-range microwave oven designs according to an embodiment of the present disclosure.

FIG. 1 illustrates the configuration of an exemplary over-the-range microwave oven according to an embodiment of the present disclosure. For purposes of illustration the interior of the oven, FIG. 1 shows that the upper cover and a side cover of the housing have been removed. FIG. 2 is a top view of FIG. 1. FIG. 3 illustrates the various air flow directions in the an exemplary over-the-range microwave oven according to an embodiment of the present disclosure.

Referring to FIGS. 1 and 2, the exemplary embodiment includes a housing 100, a cooking unit 200, a duct unit 300, and an air discharge unit 400, and further includes a filter unit 500.

The housing 100 defines the exterior of the over-the-range microwave oven, and may be made of a metal or nonmetal material. The housing 100 may include an upper cover and a lateral side cover (not illustrated), a rear cover 110 and a lower cover 120. The respective covers 100 may be integrally formed or may be detachably coupled to each other.

In addition, the housing 100 further includes a partition wall 130 which may vertically partition the interior of the housing 100 into the cooking unit 200 and the duct unit 300. The partition wall 130 may be formed integrally with the housing 100, or may be fastened to the housing 100, e.g., by bolting.

In addition, the housing 100 forms as an outer wall of the duct unit 300 which is described below.

The cooking unit 200 may include a cooking chamber and an electric equipment chamber.

The door 210 is disposed in the front of the cooking chamber. The door 210 may be hingedly coupled to the housing 100. A handle 211 may be disposed on the door 210 which allows a user to easily open and close the door 210. In addition, in order to allow the user to easily view the interior of the cooking chamber, the door 210 may further include a transparent window 212, e.g., made of tempered glass, etc.

In addition, the cooking unit 200 may include a control panel 220 disposed on one side of the door 210. The control panel 220 may include input mechanisms (such as buttons, a touch panel, or a dial) for users to control the cooking unit 200. The control panel 220 may include a display unit 221 for presenting information to users related to the operations of the over-the-range microwave oven.

In addition, the control panel 220 may also include input mechanisms (e.g., buttons, a touch panel, or a dial) for users to control the duct unit 300 as described below.

The duct unit 300 may be disposed between the housing 100 and the cooking unit 200 and forms an air flow path. In this example, the duct unit 300 is divided into an upper duct unit 300 and a lateral side duct unit 320.

The lateral side duct unit 320 is disposed between the cooking unit 200 and the side cover (not illustrated) or may be disposed between the control panel 220 and the side cover (not illustrated). In this case, the housing 100 serves as the outer wall of the duct unit 300.

Here, the lateral side duct unit 320 includes a first inlet port 321 having an opening at the lower cover 120 for admitting air from the outside of the oven. The lateral side duct unit 320 guides air flowing from the first inlet port 321 to the upper duct unit 300. A plurality of first inlet ports 321 may be formed similarly.

The upper duct unit 300 is disposed on the upper side of the cooking unit 200, and includes first panel 311, second panels 312, and/or third panel 313. By use of the upper duct unit 300, an air discharge flow path (or the exhaust path) from the rear side towards the front side is formed. Thus, a range hood and an over-the-range microwave oven according to the present disclosure may advantageously reduce turbulent air flows, electric power consumption, and noise level.

The first panel 311 is disposed inside the housing 100 and forms a bottom wall of the upper duct unit. The first panel 311 is disposed above the partition wall 130. In addition, the first panel 311 may be integrally formed as an upper surface of the partition wall 130.

In addition, the first panel 311 includes second inlet ports 311*a* in the back, through which air flows from the lateral side duct unit 320 into the upper duct unit 300. The second inlet ports 311*a* may be respectively formed on two sides of the back of the first panel 311 and correspond to a first impeller 411 and a second impeller 412 which are described below.

The first panel 311 can be made of metal or plastic, for example.

At least a pair of second panels 312 may be disposed on both lateral sides of the first panel 311. The gap between the pair of second panels decreases from one side end toward the other side end.

More specifically, two second panels 312 are disposed between the first panel 311 and the housing 100 and form the two lateral side surfaces of the upper duct unit 300, thereby partitioning the interior of the upper duct unit 300.

The gap between the pair of second panels 312 may be designed to decrease along the air flow direction. More specifically, the pair of second panels 312 may be symmetrically disposed and the gap therebetween increasingly narrows toward the front side.

The pair of second panels 312 includes a pair of first horizontal portions 312*a* disposed on both sides of the third panel 313 (as described below) and in parallel to each other. The second panels 312 further include a pair of inclined portions 312*b* extending from first horizontal portions 312*a* and having an increasingly smaller gap. The second panels 312 further include a pair of second horizontal portions 312*c* extending from the inclined portions 312*b* and disposed in parallel to each other.

According to the present disclosure, the flow path has a symmetrical geometry and becomes narrower toward the front side. The flow path may advantageously improve flow efficiency of the exhaust air or fume discharge compared to the related art, and may reduce the noise level.

Here, a connecting surface between the first horizontal portion 312*a* and the inclined portion 312*b* (or a connecting surface between the inclined portion 312*b* and the second horizontal portion 312*c* may be tapered or rounded), thereby forming an air discharge flow path offering enhanced ventilation efficiency.

The third panel 313 is disposed in the rear of the pair of second panels 312, and may have inlet holes 313*aa* and 313*ab* for air flow.

That is, referring to FIG. 3, in the air discharge flow path according to the exemplary embodiment, air may pass through the first inlet port 321, the second inlet ports 311*a* and to the impellers 411 and 412 (which redescribed below), and may flow into the inlet holes 313*aa* and 313*ab*. The air flow is then discharged to the outside through a flow path formed by the first panel 311, the second panels 312, and the upper cover 100.

In addition, the third panel 313 may include the first inlet hole 313*aa* directing to the first impeller 411, and the second inlet hole 313*ab* directing to the second impeller 412, thereby effectively enhancing the various air flows.

In addition, the third panel 313 may further include a bent portion 313*b* formed between the first inlet hole 313*aa* and the second inlet hole 313*ab* and protruding forward, thereby further enhancing the air flow.

To prevent the formation of turbulance, the bent portion 313*b* may be increasingly narrower toward the front side. For example, the bent portion 313*b* may have a trapezoidal shape.

The air discharge unit 400 is disposed between the third panel 313 and the rear surface of the housing 100, and allows air to flow into the inlet holes 313*aa* and 313*ab*. More specifically, the air discharge unit 400 may include an air discharge motor 410, and the impellers 411 and 412. The impellers 411 412 are driven by the air discharge motor 410 and allow air to flow into the inlet holes 313*aa* and 313*ab*.

Here, the first impeller 411 is disposed on one side of the air discharge motor 410. The second impeller 412 is disposed on the other side of the air discharge motor 410. Both ends of the first impeller 411 and the second impeller 412 are disposed proximate to second inlet ports 311*a*, respectively, thereby allowing air to be pumped from the outside to the inside of the housing 100, to the first panel 311, and to the second panels 312.

The filter unit 500 may be disposed on the front side of the pair of second panels 312, and specifically, may be disposed on the second horizontal portion 312*c*. The filter unit 500 may be a charcoal filter for filtering air before it is discharged to the outside. The filter unit 500 and may detachable from the oven.

An exemplary method of using the over-the-range microwave oven design according to an embodiment of the present disclosure is described below.

First, the air discharge unit 400 is activated responsive to user input using the buttons, the touch panel, or the dial disposed on the control panel 220.

Then, the air discharge motor 410 is activated and drives both impellers 411 and 412 to rotate. As such, outside air flows through the first inlet port 321 on the lateral side cover into the microwave oven, and then flows into the impellers 411 and 412 through the second inlet ports 311*a* on the first panel 311.

Therefore, air flow exits the impellers 411 and 412 at a high speed and enters into the duct, including the housing 100, the first panel 311, and the second panels 312, through the inlet holes 313*aa* and 313*ab* of the third panel 313.

In this example, the bent portion 313*b* formed on the third panel 313 guides the air flow toward the front side and can advantageoulsy prevent the formation of turbulent flow from air exitting the impellers 411 and 412. Because the second panels 312 have a symmetric geometry and form an increasingly narrower gap, air flow can be quickly discharged to the outside.

In addition, the filter is disposed between the second horizontal portions 312*c* and at the narrowest location of the flow path, thereby effectively capturing and filtering contaminants.

That is, by the operation of the air discharge unit 400, hot air or fumes around a gas or electric range or air flowing by a drive unit of a microwave oven may be discharged through the upper duct unit 300. The upper duct unit 300 is disposed between the housing 100 and the cooking unit 200 and serves as a flow path. The upper duct unit includes the first panel 311 disposed on the upper side of the cooking unit 200, the pair of second panels 312 disposed between the first panel 311 and the housing 100. The second panels are disposed symmetrically and a gap therebetween decreases toward the front side. The upper duct unit 300 further includes the third panel 313 disposed in the rear of the pair of second panels 312 and having the inlet holes 313*aa* and 313*ab* for air flow.

Embodiments of the present disclosure employ an air discharge unit 400 disposed on the rear side and configured to guide air from the rear side toward the front side. The air discharge unit 400 includes a symmetric flow path which is increasingly narrower toward the discharge port to further increase the aforementioned effects.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. An over-the-range microwave oven comprising:

a housing defining an exterior comprising a front side with a door and a rear side;

a cooking unit disposed inside the housing;

a duct unit disposed inside the housing;

a first panel disposed between the housing and the cooking unit and configured to form a wall of a flow path and forming a bottom wall of the duct unit;

a pair of second panels disposed on two lateral sides of the first panel such, wherein a gap between the pair of second panels decreases as the pair of second panels traverse a first end of the first panel toward a second end thereof, and a third panel disposed at first ends of the pair of second panels and comprising a first inlet hole and a second inlet hole, wherein the third panel further comprises a bent portion protruding toward the front side of the housing and disposed between the first inlet hole and the second inlet hole, wherein the bent portion is configured to be increasingly narrower toward the front side of the housing, wherein a front portion of the bent portion toward the front side of the housing is closed, wherein the pair of second panels comprise: a pair of first parallel portions respectively disposed on two sides of the third panel and parallel to each other; a pair of nonparallel portions extending from ends of the pair of first parallel portions, respectively, wherein the bent portion is configured to protrude to a portion where the pair of first parallel portions and the pair of nonparallel portions are connected, and wherein a gap between the pair of non-parallel portions is increasingly smaller; and a pair of second parallel portions extending from ends of the pair of non-parallel portions, respectively, and disposed parallel to each other, wherein the pair of non-parallel portions are disposed between the pair of first parallel portions and the pair of second parallel portions.

2. The over-the-range microwave oven of claim 1 further comprising:

an air discharge unit disposed in the rear side of the housing and configured to allow air to flow into the first inlet hole and the second inlet hole, wherein the air discharge unit comprises: an air discharge motor; and an impeller assembly coupled to the air discharge motor and configured to pump air into the housing through the first inlet hole and the second inlet hole.

3. The over-the-range microwave oven of claim 2, wherein the impeller assembly comprises: a first impeller disposed on one side of the air discharge motor and configured to pump air through the first inlet hole; and a second impeller disposed on another side of the air discharge motor and configured to pump air through the second inlet hole.

4. The over-the-range microwave oven of claim 1, wherein the bent portion has a trapezoidal shape.

5. The over-the-range microwave oven of claim 1, wherein a connecting surface between a first parallel portion and non-parallel portion or a connecting surface between non-parallel portion and a second parallel portion is tapered or rounded.

6. The over-the-range microwave oven of claim 1, wherein the pair of second panels are disposed symmetrically with respect to each other.

7. The over-the-range microwave oven of claim 1 further comprising a filter disposed in front of the pair of second panels.

* * * * *